United States Patent [19]

Raasch

[11] Patent Number: 4,890,942

[45] Date of Patent: Jan. 2, 1990

[54] SUPPORT DISK ASSEMBLY FOR THE ROTOR SHAFT OF AN OPEN END SPINNING MACHINE

[75] Inventor: Hans Raasch, Monchen-Gladbach, Fed. Rep. of Germany

[73] Assignee: W. Schlafhorst & Co., Fed. Rep. of Germany

[21] Appl. No.: 93,008

[22] Filed: Sep. 4, 1987

[30] Foreign Application Priority Data

Sep. 5, 1986 [DE] Fed. Rep. of Germany ..... 3630257

[51] Int. Cl.[4] ..... F16C 19/00; D01H 1/24

[52] U.S. Cl. ..... 384/549; 57/406

[58] Field of Search ..... 384/549, 550, 548, 569, 384/277, 278, 297, 418, 900; 57/103, 406

[56] References Cited

U.S. PATENT DOCUMENTS 3,183,730 5/1965 Scragg et al. ..... 384/549 X
3,996,653 12/1976 Faris et al. ..... 57/103 X
4,676,673 6/1987 Stahlecker ..... 384/549
4,713,932 12/1987 Zott ..... 57/406

FOREIGN PATENT DOCUMENTS 1801120 9/1959 Fed. Rep. of Germany .
3205566 8/1983 Fed. Rep. of Germany .

*Primary Examiner*—Thomas R. Hannon
*Attorney, Agent, or Firm*—Shefte, Pinckney & Sawyer

[57] ABSTRACT

A support disk assembly for rotatably mounting alongside a like support disk assembly as a bearing for rotatably supporting a shaft, such as the rotor shaft of an open end spinning machine. The disk assembly includes a pair of disk members each with a respective clamping flange selectively attachable and detachable from one another for grippingly retaining a tread member between the clamping flanges in operation while permitting easy removal and replacement of the tread member when worn by disassembly of the disk members.

12 Claims, 1 Drawing Sheet

SUPPORT DISK ASSEMBLY FOR THE ROTOR SHAFT OF AN OPEN END SPINNING MACHINE

BACKGROUND OF THE INVENTION

The present invention relates generally to a support disk assembly useful for rotatable mounting alongside another support disk assembly as a bearing for rotatably supporting a shaft, particularly for example a rotating shaft supporting the rotor of an open end spinning machine.

In open end spinning machines, the spinning rotor is mounted for high speed spinning operation on a driven support shaft which may be supported for rotation by a bearing arrangement having a plurality of support disks or wheels rotatably arranged in side-by-side pairs on parallel axes to define a nip between the disk pairs in which the rotor shaft is supported. Typically, each support disk or wheel includes a disk body having a central hub for mounting on a supporting shaft and a peripheral rim arrangement which supports an annular tread member for peripheral frictional rolling contact with the rotor shaft as it is driven. Typically, the tread member is fabricated of a wear-resistant elastomeric material which is permanently attached to the rim arrangement by adhesive or by a vulcanization process. Due to the high operating speeds at which the rotor shaft of such open end spinning machines typically run, the tread member wears rapidly, requiring periodic replacement. Disadvantageously, however, the adhesive or vulcanized attachment of the tread to the support disk assembly makes it difficult to remove the worn tread economically for replacement with a new tread. Accordingly, in the practice, once the tread becomes worn, the entire disk assembly is discarded and replaced with a new disk assembly.

SUMMARY OF THE INVENTION

It is accordingly an object of the present invention to provide an improved support disk assembly of the basic type described above which enables the ready removal and replacement of the tread member without discarding the other components of the disk assembly, thereby to enhance the economical operation of an open end spinning machine.

Briefly summarized, the support disk assembly of the present invention achieves this object by providing a disk body with a clamping arrangement at its periphery for grippingly retaining the tread member, the clamping arrangement being selectively releasable for permitting removal and replacement of the tread member.

In the preferred embodiment of the present invention, the disk body includes a disk member and a carrier member which are detachably connectable to one another, the clamping arrangement including a pair of flange members affixed respectively at the periphery of the disk and carrier members for cooperative clamping relation with one another when the disk and carrier members are connected. Thus, the clamping arrangement is configured to engage the tread member at opposite axially-facing sides thereof. Preferably, the tread member is of a greater axial dimension than the clamping arrangement for exerting clamping pressure on the axially-facing sides of the tread member. The carrier member may be a second disk member for connection in facing relation to the first-mentioned disk member. Advantageously, each of the disk and carrier members together with its associated flange member may be integrally fabricated from sheet metal.

Preferably, the flange members cooperatively define a tapered recess for receiving the tread member when the disk and carrier members are connected and the tread member is compatibly configured with tapered axially-facing side surfaces. As desired, the flange members may be formed to be non-continuous annularly. For example, in one embodiment, each flange member includes a plurality of flange fingers arranged at spacings annularly about the flange member and the tread member includes a plurality of annularly arranged recesses for receiving the fingers.

A plurality of mechanical fasteners are provided for detachably affixing the disk and carrier members. Preferably, a plurality of set screws, each having a stem and a relatively enlarged head, are utilized as the mechanical fasteners and are rigidly affixed to one of the disk and carrier members. The other of the disk and carrier members is provided with a corresponding plurality of recesses, each recess being formed with an enlarged entrance area adapted for receipt of the enlarged head and a relatively reduced retention area for snug receipt of the stem. In this manner, the recesses permit relative rotation of the disk and carrier members when the set screws are received in the recesses for disposition of the set screws in the enlarged entrance areas or in the reduced retention areas of the recesses to enable selective attachment and detachment of the disk and carrier members. Each of the disk and carrier members further includes a pair of openings in their respective axially outward surfaces for receipt of appropriate tools to actuate selective relative rotation of the disk and carrier members to accomplish the aforesaid attachment and detachment thereof.

DESCRIPTION OF THE PREFERRED EMBODIMENT

Figure 1:
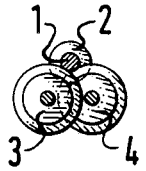
FIG. 1 is a schematic view representatively illustrating a pair of the support disk assemblies of the present invention arranged in their preferred embodiment as a bearing for rotatably supporting the rotor shaft of an open end spinning machine.

Referring now to the accompanying drawings and initially to FIG. 1, a pair of support disk assemblies according to the preferred embodiment of the present invention are shown at 3 and 4 in a typical side-by-side arrangement mounted on parallel support shafts to define a nip between the support disk assemblies 3,4 in which is supported a drive shaft 1 to the spinning rotor 2 of a typical open end spinning machine. The shaft 1 is driven by a tangential belt, now shown herein, in conventional manner.

Figure 3:
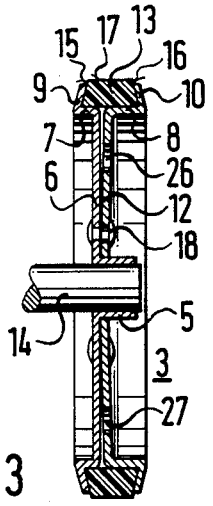
FIG. 3 is a cross-sectional view taken axially through the support disk assembly of FIG. 2.
Figure 2:
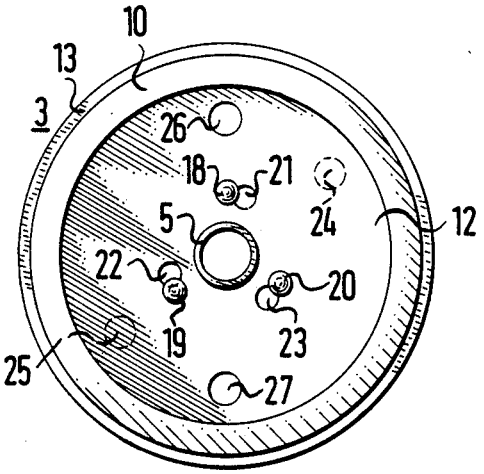
FIG. 2 is a front elevational view of one of the support disk assemblies of FIG. 1.

The particular construction of the support disk assemblies 3,4 according to the present invention is shown in greater detail in FIGS. 2 and 3 wherein the support disk assembly 3 is shown by way of example. Each support disk assembly 3,4 basically includes a disk body formed of a disk member 6 and a carrier member 12 mounted in facing abutment to one another. Preferably, the carrier member 12 is also of a disk-shaped configuration which enhances the mounting thereof to the disk member 6 and improves the stability of the disk body. The disk member 6 includes a central hub 5 by which the support disk assembly is fixed to a support shaft 14 rotatably mounted on the open end spinning machine in conventional manner, not shown herein. The disk and carrier members 6,12 respectively include annular rims 7,8 which extend in axially-opposite directions away from one another annularly about the respective peripheries of the disk and carrier members 6,12. Similarly, the disk and carrier members 6,12 also respectively include annular clamping flanges 9,10 which extend radially outwardly from the respective rims 7,8 about the full annular extent of the disk and carrier members 6,12. In this manner, the respective rims and flanges 7,8,9,10 of the disk and carrier members 6,12 define a radially outwardly opening channel in the assembled condition of the disk and carrier members 12, in which an annular tread member 13 is clampingly received with the flanges 9,10 engaging opposite axially facing sides of the tread member 13.

According to the present invention, the flanges 9,10 extend angularly in converging fashion toward one another from their associated rims 7,8 to define the channel of a tapered shape. Correspondingly, the tread member 13 is configured of a compatible shape with tapered axially-facing side surfaces 15,16. In this manner, the tread member 13 resembles an inverted V-belt with its narrow annular surface 17 facing outwardly rather than inwardly and the rims and flanges 7,8,9,10 of the disk and carrier members 6,12 resemble a V-belt pulley but with its radial flanges converging in the radially outward rather than radially inward direction. The tread member 13 is preferably fabricated of a resilient wear-resistant elastomeric material of a greater axial thickness than the axial dimension of the tapered channel defined between the clamping flanges 9,10. In this manner, the clamping flanges 9,10 of the disk and carrier members 6,12 grippingly engage and exert clamping pressure on the tapered facing side surfaces 15,16 of the tread member 13 when assembled, as depicted by the exaggerated spacing between the disk and carrier members 6,12 in FIG. 3.

A plurality of mechanical fasteners 18,19,20 are utilized to connect the disk and carrier members 6,12 in a releasable fashion in the assembled relationship shown in FIGS. 2 and 3. The fasteners 18,19,20 are preferably set screws of the type having an enlarged head at one end of a fastener stem, and are permanently fixed to the facing surface of the disk member 6 concentrically about its central hub 5. Alternatively, the fasteners 18,19,20 may be screws, rivets or similar fasteners. A corresponding plurality of recesses 21,22,23 are similarly formed concentrically in the facing surface of the carrier member 12. The recesses 21,22,23 are of a keyhole-like shape, each having an enlarged entrance area adapted for receipt and extension therethrough of the enlarged head of a fastener 18,19,20 and a relatively reduced retention area alongside the entrance area sized for snug receipt of the stem of a fastener 18,19,20 with the fastener head in facing abutment with the adjacent surface of the carrier member 12. As will thus be understood, the recesses 21,22,23 permit selective insertion and removal of the set screw fasteners 18,19,20 into and from the enlarged entrance areas of the recesses 21,22,23 and further permit relative rotation of the disk and carrier members 6,12 when the set screws 18,19,20 are received in the recesses 21,22,23 for selective disposition of the set screws either in the enlarged entrance areas of the recesses 21,22,23, for assembly and disassembly of the disk and carrier members 6,12, or in the reduced retention areas of the recesses 21,22,23, wherein the stems of the set screws are snugly engaged in the retention areas with the heads in facing abutment with the adjacent surface of the carrier member 12. In this manner, the disk and carrier members 6,12 are enabled to be selectively attached and detached to and from one another, as desired.

To facilitate this manner of attachment and detachment of the disk and carrier members 6,12, the disk member 6 is formed with a pair of diametrically opposed openings 24,25 and the carrier member 12 is similarly formed with a pair of diametrically opposed openings 26,27. Thus, each of the disk and carrier members 6,12 is adapted for receiving in its respective openings 24,25 and 26,27 a compatible tool (not shown) having a pair of correspondingly spaced pins to enable actuation of relative rotation between the disk and carrier members 6,12 by holding one such tool stationary while the other such tool is rotated relative thereto in the manner of a wrench, for assembly or disassembly of the disk and carrier members 6,12, as desired.

As will thus be understood, the support disk assembly of the present invention enables quick and easy attachment and detachment of the disk and carrier members 6,12 as desired or necessary for removing a worn tread member 13 and replacing it with a new tread member 13, without significant difficulty and avoiding the conventional necessity of discarding the disk body components along with the worn tread member. In certain circumstances, the support disk assembly need not be removed from the open end spinning machine in order to replace the tread member 13. Advantageously, no adhesive or vulcanization process need by utilized to affix the tread member 13 in place. Instead, the described configuration of the disk and carrier members 6,12 provides an effective gripping retention of the tread member 13 in place. The differential dimensioning of the tread member 13 and the channel defined by the clamping flanges 9,10 together with the tapered configuration of these components, effectively exerts clamping pressure on the axially facing side surfaces 15,16 of the tread member 13 in both the axial and radially inward directions, thereby firmly holding the tread member 13 against the action of centrifugal force as well as forces exerted on the tread member by the supported rotor shaft 1. Thus, a secure seating of the tread member 13 in the channel defined between the clamping flanges 9,10 is assured. As desired, either or both the tread member 13 and the disk and carrier members 6,12 may be provided with sufficient resiliency to accommodate the differential axial dimensioning of the tread member 13 and the channel during assembly of the disk and carrier members 6,12 therewith. Of course, as those persons skilled in the art will recognize, each new tread member 13 should be ground to a desired diameter with a close tolerance, which operation can be performed completely automatically.

Preferably, each disk member 6, together with its associated rim and flanges 7,9, and the carrier member 12, together with its associated rim and flange 8,10, is integrally fabricated of sheet metal. By way of example, each such part may initially be stamped from sheet metal plates and subsequently shaped to the described configuration by the well-known deep drawing process. As will be understood, the hub 5 may under appropriate circumstances also be formed integrally with the disk member 6. In this manner, only two component parts, other than the tread member 13, are required for each support disk assembly, making the support disk assembly more economical to manufacture and simpler and easier to assemble and disassemble for removing and replacing a worn tread member 13.

Figure 4:
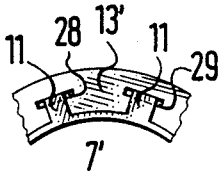
FIG. 4 is a partial front elevational view similar to FIG. 2, showing another embodiment of the present support disk assembly.

With reference now to FIG. 4, an alternative embodiment of the support disk assembly of the present invention is shown wherein the clamping flanges of the disk and carrier members are non-continuous annularly thereabout but, instead, each flange includes a plurality of claw-like flange fingers 11 projecting radially from the respective rim portion, rim 7' being shown by way of example, at spacings annularly thereabout. The tread member 13' in this embodiment is modified to include a plurality of annularly arranged recesses such as recesses 28,29 for engagement therein of the flange fingers 11 to retain the tread member 13' in place annularly about the periphery of the disk and carrier members 6,12. Advantageously, this construction of the flanges reduces the overall weight of the disk assembly to provide further economy in the manufacture and operation thereof. Additionally, with this compatible inter-engaging construction of the flange fingers 11 and the tread member 13', the flanges and tread member need not be of a tapered configuration, as in the embodiment of FIGS. 2 and 3, while still providing effective gripping engagement and retention of the tread member 13'.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. In an open end spinning machine having a spinning rotor mounted on a rotor shaft, a support disk assembly rotatably mounted alongside another support disk assembly as a bearing for rotatably supporting said rotor shaft, each said support disk assembly comprising a disk body for rotatable mounting alongside said shaft, said disk body including a disk member and a carrier member detachably connectable to one another, an annular tread member for disposition about the periphery of said body for peripheral contact frictionally with said shaft, and clamping means at the periphery of said disk body for grippingly retaining said tread member in a substantially fixed disposition radially with respect to said disk body and being selectively releasable for permitting removal and replacement of said tread member, said clamping means including a pair of flange members respectively affixed at the periphery of said disk and carrier members for cooperative clamping retention with one another when said disk members are connected, said flange members cooperatively defining a tapered channel for receiving said tread member when said disk and carrier members are connected and said tread member is compatibly configured with tapered axially-facing side surfaces.

2. A support disk assembly according to claim 1 and characterized further in that said clamping means is configured to engage said tread member at opposite axially facing sides thereof.

3. A support disk assembly according to claim 1 and characterized further in that said carrier member is a second disk member for connection in facing relation to said first-mentioned disk member.

4. A support disk assembly according to claim 1 and characterized further in that said flange members are non-continuous annularly.

5. A support disk assembly according to claims 4 and characterized further in that each said flange member includes a plurality of flange fingers arranged at spacings annularly about said flange member and said tread member includes a plurality of annularly arranged recesses for receiving said fingers.

6. A support disk assembly according to claim 1 and characterized further in that said disk member and its associated flange member are integrally fabricated from sheet metal, and said carrier member and its associated flange member are integrally fabricated from sheet metal.

7. In an open end spinning machine having a spinning rotor mounted on a rotor shaft, a support disk assembly rotatably mounted alongside another support disk assembly as a bearing for rotatably supporting said rotor shaft, each said support disk assembly comprising a disk body for rotatable mounting alongside said shaft, said disk body including a disk member and a carrier member, a plurality of mechanical fasteners for detachably affixing said disk and carrier members, an annular tread member for disposition about the periphery of said body for peripheral contact frictionally with said shaft, and clamping means at the periphery of said disk body for grippingly retaining said tread member in a substantially fixed disposition radially with respect to said disk body and being selectively releasable for permitting removal and replacement of said tread member, said clamping means including a pair of flange members respectively affixed at the periphery of said disk and carrier members for cooperative clamping relation with one another when said disk members are connected.

8. A support disk assembly according to claim 7 and characterized further in that said mechanical fasteners are rigidly affixed to one of said disk and carrier members and the other thereof includes a corresponding plurality of recesses for receiving said fasteners.

9. A support disk assembly according to claim 8 and characterized further in that said fasteners comprise set screws each having a stem and a relatively enlarged head and each said recess is formed with an enlarged entrance area adapted for receipt of said enlarged head and a relatively reduced retention area for snug receipt of said stem, said recesses permitting relative rotation of said disk and carrier members when said set screws are received in said recesses for disposition of said set screws in said enlarged entrance areas or said reduced retention areas of said recesses to enable selective attachment and detachment of said disk and carrier members.

10. A support disk assembly according to claim 9 and characterized further in that each of said disk and carrier members includes a pair of openings in their respective axially outward surfaces for receipt of appropriate tools to actuate selective relative rotation of said disk and carrier members for assembly and disassembly thereof.

11. In an open end spinning machine having a spinning rotor mounted on a rotor shaft, a support disk assembly rotatably mounted alongside another support disk assembly as a bearing for rotatably supporting said rotor shaft, each said support disk assembly comprising a disk body for rotatable mounting alongside said shaft, an annular tread member for disposition about the periphery of said body for peripheral contact frictionally with said shaft, said clamping means at the periphery of said disk body for grippingly retaining said tread member in a substantially fixed disposition radially with respect to said disk body and being selectively releasable for permitting removal and replacement of said tread member, said tread member being of a greater axial dimension than said clamping means for exerting clamping pressure on the axially facing sides of said tread member.

12. In an open end spinning machine having a spinning rotor mounted on a rotor shaft, a support disk assembly rotatably mounted alongside another support disk assembly as a bearing for rotatably supporting said rotor shaft, each said support disk assembly comprising a disk body for rotatable mounting alongside said shaft, said disk body including a disk member and a carrier member detachably connectable to one another, an annular tread member for disposition about the periphery of said body for peripheral contact frictionally with said shaft, and clamping means at the periphery of said disk body for grippingly retaining said tread member in a substantially fixed disposition radially with respect to said disk body and being selectively releasable for permitting removal and replacement of said tread member, said clamping means including a pair of flange members respectively affixed at the periphery of said disk and carrier members for cooperative clamping relation with one another when said disk members are connected, each said flange member including a plurality of flange fingers arranged at spacings annularly about said flange member and said tread member includes a plurality of annularly arranged recesses for receiving said fingers.

* * * * *